US005265577A

United States Patent [19]

Denz et al.

[11] Patent Number: 5,265,577

[45] Date of Patent: Nov. 30, 1993

[54] METHOD AND ARRANGEMENT FOR CHECKING THE OPERABILITY OF A TANK-VENTING SYSTEM

[75] Inventors: Helmut Denz, Stuttgart; Andreas Blumenstock, Ludwigsburg, both of Fed. Rep. of Germany

[73] Assignee: Robert Bosch GmbH, Stuttart

[21] Appl. No.: 965,380

[22] PCT Filed: Mar. 25, 1992

[86] PCT No.: PCT/DE92/00244

§ 371 Date: Dec. 17, 1992

§ 102(e) Date: Dec. 17, 1992

[87] PCT Pub. No.: WO92/18765

PCT Pub. Date: Oct. 29, 1992

[30] Foreign Application Priority Data

Apr. 17, 1991 [DE] Fed. Rep. of Germany ..... 4112481

[51] Int. Cl.[5] ..... F02M 33/04

[52] U.S. Cl. ..... 123/520; 123/198 D

[58] Field of Search ..... 123/516, 518, 519, 520, 123/198 D, 698

[56] References Cited

U.S. PATENT DOCUMENTS

| | | | |
|---|---|---|---|
| 4,926,825 | 5/1990 | Ohtaka et al. | 123/520 |
| 4,949,695 | 8/1990 | Uranishi et al. | 123/198 D |
| 5,186,153 | 2/1993 | Steinbrenner et al. | 123/520 |
| 5,191,870 | 3/1993 | Cook | 123/198 D |
| 5,195,498 | 3/1993 | Siebler et al. | 123/520 |
| 5,197,442 | 3/1993 | Blumenstock et al. | 123/198 D |
| 5,220,896 | 6/1993 | Blumenstock et al. | 123/198 D |

FOREIGN PATENT DOCUMENTS

| | | |
|---|---|---|
| 0411173A1 | 2/1991 | European Pat. Off. . |
| 2635823 | 3/1990 | France . |
| WO91/12426 | 8/1991 | World Int. Prop. O. . |
| WO91/16216 | 10/1991 | World Int. Prop. O. . |

*Primary Examiner*—E. Rollins Cross
*Assistant Examiner*—Thomas Moulis
*Attorney, Agent, or Firm*—Walter Ottesen

[57] ABSTRACT

A method for checking the operability of a tank-venting system for a motor vehicle having an internal combustion engine with a lambda controller, which system has an adsorption filter with a connecting line to a tank and a connecting line to the intake pipe of the engine which is provided with a tank-venting valve. The method is characterized in that a lean correction check is performed as soon as an operating condition with low air throughput through the engine is present. If the check determines a lean correction (ΔFR) of the lambda controller which is less than a pregiven lean correction threshold value (ΔFR_SW), there is a pressure change check provided with respect to the pressure in the tank as soon as an operating condition is present with a high air throughput through the tank-venting valve. The tank-venting system is deemed to be operative if a pressure change effect of pregiven quality (ΔDp>ΔDp_SW) is determined. This method has the advantage that the pressure change check, which interferes with the tank-venting operation, is only performed when the first performed lean correction check indicates that there is only a small amount of fuel to be regenerated. In this case, arbitrary closing operations of the tank-venting valve for the pressure check do not disturb the tank-venting operation in a significant manner.

10 Claims, 3 Drawing Sheets

Start s2.1
Idling ?
n
n
A
s2.3
End
System leaktight
s2.2
ΔFR <-0,05 ?
n
B
A
ΔFR<-0,15 ?
n
B
Large Quantity of Air through valve for more than 10 seconds?
s2.4
n Measure Dp_OPEN
s2.5
C
Close Valve
s2.6
Measure Dp_CLOSED
s2.7
ΔDp = Dp_CLOSED - Dp_OPEN
s2.8
D
s2.10
End
System leaktight
s2.9
ΔDp >ΔDp_SW ?
n
2.11
System leaks
End

METHOD AND ARRANGEMENT FOR CHECKING THE OPERABILITY OF A TANK-VENTING SYSTEM

FIELD OF THE INVENTION

The following relates to a method and an arrangement for checking the operability of a tank-venting system for a motor vehicle having an internal combustion engine with a lambda controller.

BACKGROUND OF THE INVENTION

It is known to check the operability of a tank-venting system by checking, when operating an internal combustion engine with a lambda controller at a low load, whether a lean correction by the lambda controller is necessary on the basis of the gas supplied to the engine from the tank-venting system. This method is insofar unreliable in that it is quite possible that the fuel in the tank will hardly vaporize, this having the consequence that, during regeneration of the adsorption filter of the system, the air drawn by suction through this filter will not be charged with fuel. For this reason, the lambda controller will then have to perform a correction in the rich direction in order to add fuel to the air supplied from the tank-venting system.

The California Environmental Authority (CARB) therefore proposed in 1989, in the context of a set of regulations, to determine, with the aid of a filling level sensor and a temperature sensor in the tank, whether the motor vehicle to which the system is fitted has been refuelled and whether the fuel introduced into the tank is sufficiently warm to allow the assumption that vaporizing of the fuel is occurring. If the signals from these measuring sensors in the tank indicate that an inflow of fuel vapor into the tank-venting system is to be expected but nevertheless no lean correction is detected by the lambda controller, this is to be taken as an indication of non-operability of the tank. This process has the disadvantage that, when the chosen temperature above which vaporizing of the fuel is assumed is relatively high, no check of the operability can be carried out for relatively long periods of time in cold weather, when the fuel is cold. If the mentioned temperature threshold is set lower, there is the risk that an incorrect statement regarding the operability of the system will be made, namely, if no fuel vapor escapes because essentially fully vaporized fuel has been introduced into the tank. Due to the measurement data from the sensors in the tank, vaporization of the fuel is then erroneously assumed whereas in fact it does not occur, and it is accordingly impossible for a lean correction to be performed by the lambda controller.

U.S. patent application Ser. No. 768,973, filed Oct. 8, 1991, describes tank-venting system which has a differential pressure sensor on the tank and an adsorption filter with a ventilation line which can be blocked. In order to check the operability of the tank, this ventilation line is blocked and a check is then carried out with the tank-venting valve open to determine whether a vacuum builds up in the tank relative to the ambient pressure. If this is the case, the system is deemed to be operational. In one embodiment of the method, provision is made to test for a lean correction by the lambda controller when the tank-venting valve is opened if an overpressure in the tank has been detected beforehand, that is, while the tank-venting valve is still closed.

Another earlier application (DE-A-41 09 401) describes a method for checking the operability of a tank-venting system and, in accordance with this method, while the tank-venting valve is open, a check is simultaneously made to determine whether a lean correction is performed by the lambda controller and whether a tank differential pressure greater than a predetermined threshold is detected. If at least one of the two conditions is fulfilled, the system is deemed to be operative.

Despite these known and proposed tank-venting systems and methods and arrangements for checking the operability of the systems, there continues to be the desire to provide improved methods and arrangements of this kind.

SUMMARY OF THE INVENTION

The method according to the invention is for checking the operability of a tank-venting system for a motor vehicle having an internal combustion engine with a lambda controller. This system has an adsorption filter with a connecting line leading to a tank and a connecting line with an inserted tank-venting valve leading to the intake pipe of the engine. The method of the invention is characterized in that, as soon as an operating condition is present in which there is a low air throughput through the engine, a lean correction check is performed. If, in the process, a lean correction ($\Delta FR$) of the lambda controller is detected which is smaller than a predetermined lean correction threshold value ($\Delta FR_SW$), a pressure change check regarding the pressure in the tank is performed as soon as an operating condition with a high air throughput through the tank-venting valve is present. The tank-venting system is deemed to be operative if a pressure change effect of a predetermined quality ($\Delta Dp > \Delta Dp_SW$) is detected.

The arrangement according to the invention for checking the operability of a tank-venting system is designed to carry out the above features which characterize the method and to emit an evaluation signal having two states, one state indicating operability and the other a lack of operability of the system.

It is an essential characteristic of the method of the invention that the tank pressure change check is only carried out if the lean correction check has indicated that there is little fuel to be recovered. It is then certain that the interference into the regeneration sequence by the arbitrary closing of the tank-venting valve during the pressure change check will be without noticeable effects on the result of regeneration.

The method preferably proceeds in such a way that, with the result of the lean correction check, it is merely decided whether the pressure change check should be carried out or not. If the pressure change check is carried out, it alone determines whether the system is operative or not. However, a simpler method is one in which, with a noticeable lean correction, the conclusion is immediately drawn that the system is operative and the pressure change check is only carried out if it was not possible to make a decision with the aid of the lean correction check.

If it results with the tank pressure change check that the tank pressure change effect does not fulfill the predetermined quality condition, then, according to one embodiment, the system is deemed to be non-operative. This direct conclusion is possible in the case of a combination of an internal combustion engine and a tank-venting system in which significant pressure change effects occur. Otherwise, it is more advantageous to carry out another lean correction check, but only if an operating condition with a low air throughput through the engine is reached within a predetermined time period following the pressure change check If the predetermined quality condition has not been fulfilled during the last pressure change check, this may be due to the fact that the fuel in the tank is vaporizing strongly. Fuel vapor must then be adsorbed in the adsorption filter. If the tank-venting valve is closed at the end of the pressure change check, this adsorbed fuel must remain in the adsorption filter, so that it can be detected in a lean correction check. Since, however, with the tank-venting valve closed, no tank venting can take place, the possibility of carrying out a lean correction check at low air throughput rates through the engine is not awaited for an indefinite period; on the contrary, it is awaited for only a predetermined time period following the end of the last pressure change check.

In order to obtain as reliable values as possible for the pressure measurements, it is advantageous, after each change in the opening condition of the tank-venting valve, to first await the establishment of a pressure equilibrium within a predetermined time period. Only then is the pressure associated with the respective opening condition of the tank-venting valve measured. The measured pressure is preferably the differential pressure between the tank internal pressure and the ambient pressure.

DESCRIPTION OF THE PREFERRED EMBODIMENTS OF THE INVENTION

Figure 1:
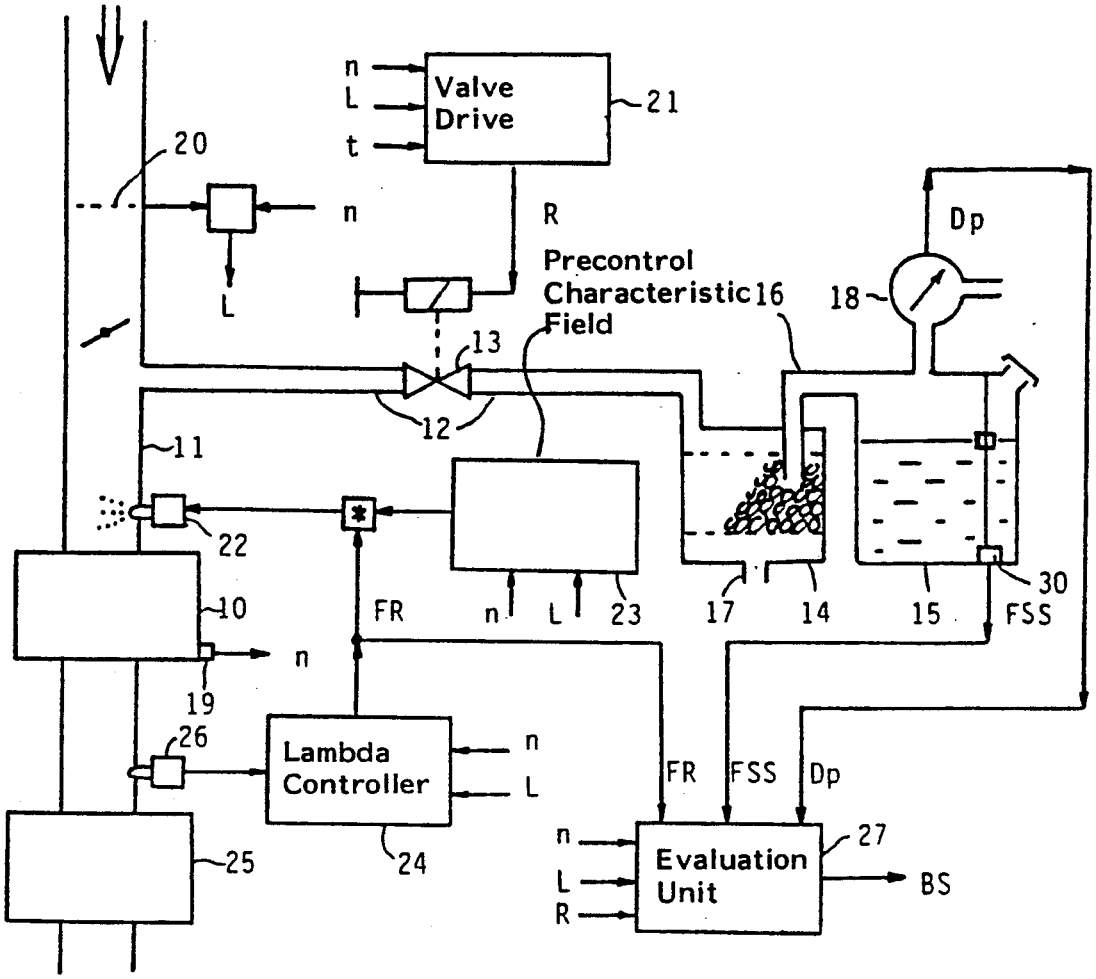
FIG. 1: schematic representation of a tank-venting system with an arrangement for checking the operability of the tank-venting system.

The tank-venting system, shown in FIG. 1 on an internal combustion engine 10 with an intake pipe 11, has a connecting line 12 with an inserted tank-venting valve 13 between the intake pipe 11 and an adsorption filter 14 and a connecting line 16 leading from the filter 14 to the tank 15. A ventilating line 17 opens into the bottom of the adsorption filter 14 at its ventilation side. The connecting line 16 dips some way into the activated carbon filling 29 of the filter. As a result, the pressure prevailing at its outlet is essentially still the intake-side pressure transmitted via the connecting line from the tank-venting valve, yet there is a good adsorption effect for a sudden large quantity of fuel vapor, as is the case, for example, in the event the tank is jarred. This makes possible reliable pressure measurements with the aid of a differential pressure sensor 18 on the tank without the driving qualities of the engine being impaired by sudden large quantities of fuel vapor from the tank-venting system.

An engine speed sensor 19 is present on the engine 10 for determining the engine speed n. An air-mass meter 20 is arranged in the intake pipe 11 for detecting the air mass flowing into the engine. The air-mass meter supplies a load signal L which, together with the engine speed n, is used to determine the operating condition of the engine 10. The operating condition furthermore depends on the time t, namely to the effect that, in a basic embodiment, operation with and without tank venting takes place alternately in a fixed time frame.

For operation with and without tank venting, the tank-venting valve 13 is controlled by a drive arrangement 21 in a known manner in such a way that an appropriate pulse duty cycle of the valve is set for each operating condition of the engine.

Fuel is metered to the engine 10 via a fuel-metering arrangement 22 which is precontrolled with the aid of values from a fuel-metering precontrol and is controlled with the aid of a lambda control factor FR and adaptation values which are combined with the precontrol values. The adaptation variables are not illustrated in FIG. 1; only a multiplicative combination of the control factor FR from a lambda controller 24 with the precontrol values is shown. Inter alia, the lambda controller 24 receives in a known manner a signal from the lambda probe 26 arranged upstream of a catalytic converter 25.

An evaluation unit 27 receives the signals relating to the engine speed n, the load L and the pulse-duty ratio R of the tank-venting valve in order to identify the operating condition of the engine and of the tank-venting valve from these variables. Furthermore, the control factor FR and the the signal Dp from the differential pressure transducer 18 are supplied to the evaluation unit 27. Finally, the unit 27 also receives a filling level signal FSS from a filling-level sensor 30 in the tank 15.

This evaluation unit 27 carries out a method according to the invention for checking and evaluating the operability of the tank-venting system. A first example of this is now explained with reference to the flowchart of FIG. 2.

Figures 2, 5:
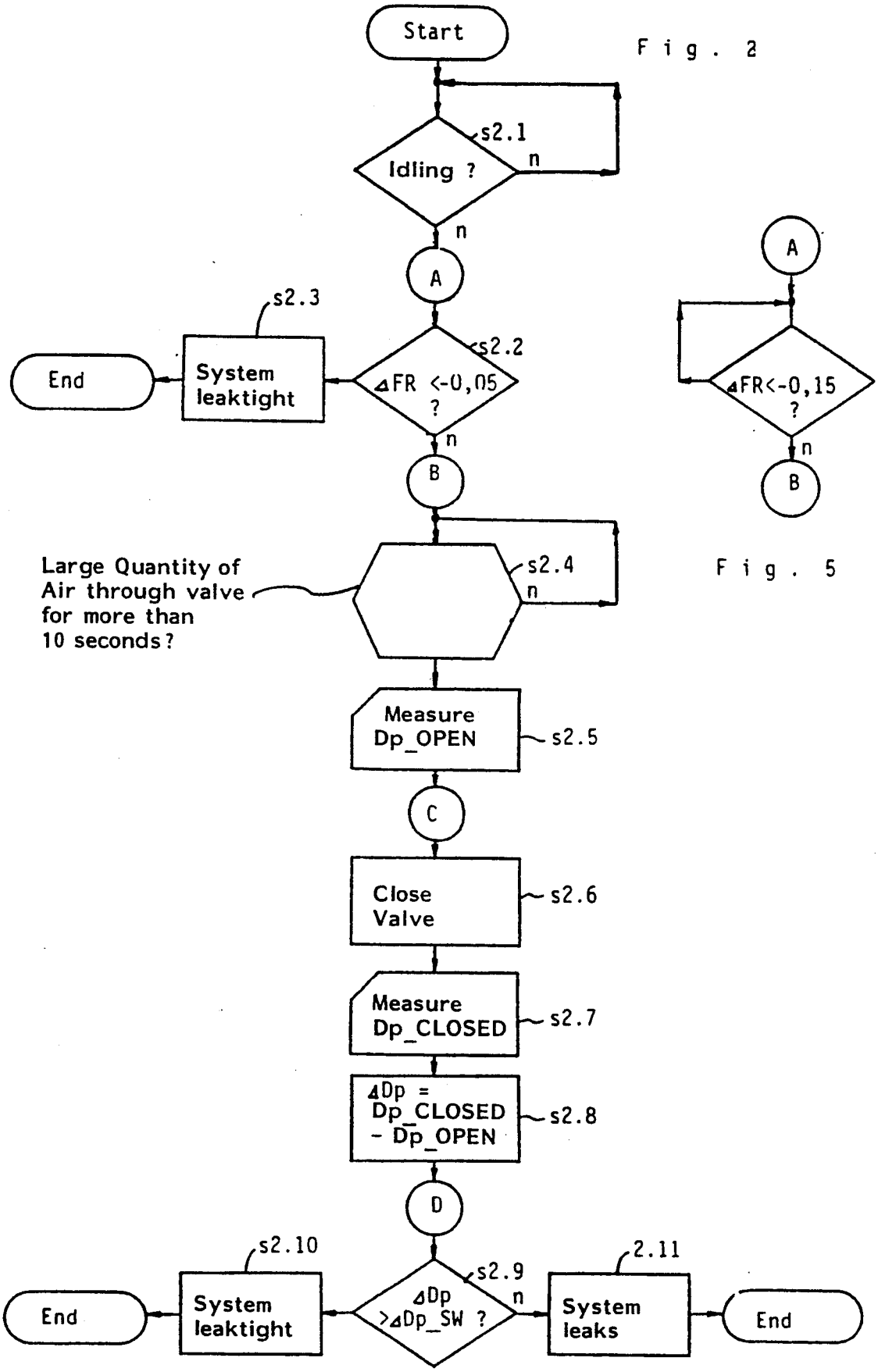
FIG. 2: flowchart for the purpose of describing an embodiment of a method for checking the operability of a tank-venting system.

According to the flowchart of FIG. 2, a check is carried out in a first step s2.1 after the start of the method to determine whether the engine is being operated in idling mode. This is an operating condition preferred for a lean correction check, with a low air throughput through the engine. This step is carried out until the presence of idling is detected. If this is the case, then, after passing through a mark A, a test is carried out to determine whether the low-pass-filtered control factor difference $\Delta FR$ is $< -0.05$ (step s2.2). For this purpose, the tank-venting valve is opened after a predetermined time period, for example 2 seconds, after reaching the idling condition, with an increasing pulse-duty ratio starting from the closed condition and the difference is determined between the control factors with the tank-venting valve closed and with the tank-venting valve cyclically open. If the condition is fulfilled, the system is deemed to be operative in a step s2.3 and the method is ended. The method is frequently run only as far as this step and this has the advantage that the cycle described below, which interferes with the tank-venting method, has only rarely to be worked through. It should be noted at this point that the checking method described here is typically carried out only once during each driving cycle of a vehicle.

If no lean correction is detected in step s2.2, a check is carried out (step s2.4, which is reached via the mark B) to determine whether a high air throughput through the tank-venting valve was present for more than 10 seconds. A high air throughput through the tank-venting valve leads to large underpressures and hence to good pressure change check conditions for the pressure in the tank. Such air throughputs occur in the case of medium and high loads on the internal combustion engine. In the case of low loads, that is, in particular during idling, the pulse-duty ratio of the tank-venting valve must be chosen such that virtually no air passes through the valve so as to avoid disturbing the idling mode; whereas, in the case of full load, only a weak underpressure is transmitted from the intake pipe, for which reason in this condition only small air throughputs through this valve and hence small underpressures in the tank are obtained despite the tank-venting valve being continuously open. A waiting period of 10 seconds is observed as an underpressure build-up period.

Step s2.4 is repeated until the condition in this step is fulfilled. When it is, the following step s2.5 is reached, in which the differential pressure Dp_OPEN is measured, that is, the differential pressure in the tank with the tank-venting valve open. After this pressure has been recorded, the valve is closed (step s2.6, which is reached via a mark C) and, after an underpressure breakdown period Δt_CLOSED, the differential pressure Dp_CLOSED is measured, that is, the differential pressure in the tank relative to the ambient pressure with the valve closed (step s2.7). With the aid of the two measured pressures, the differential pressure change ΔDp is calculated (step s2.8) and, after passing through a mark D, a check is carried out (step s2.9) to determine whether this differential pressure change is greater than a threshold value ΔDp_SW. If this is the case, the system is deemed to be operative (step s2.10); whereas, otherwise the system is deemed not to be operative (step s2.11). In either case, the method is then ended.

Since, in the method just described, the differential pressure change is recorded just once and a statement is then made immediately on the operability of the system, this can only be carried out in systems in which large differential pressure changes of, for example, 10 mbar or more are to be expected. However, this is only so in the case of a very small number of systems. In order to increase the reliability of the statement, it is first possible to repeat the sequence of steps s2.4 to s2.9 several times, to record each time the result in step s2.9 and only to draw a conclusion as to the operability of the system when a predetermined minimum percentage of cases, in which the respectively measured differential pressure change exceeds the predetermined threshold value, is exceeded. Even more reliable, however, are variants of the method as described below with reference to FIGS. 3 and 4.

Figure 3:
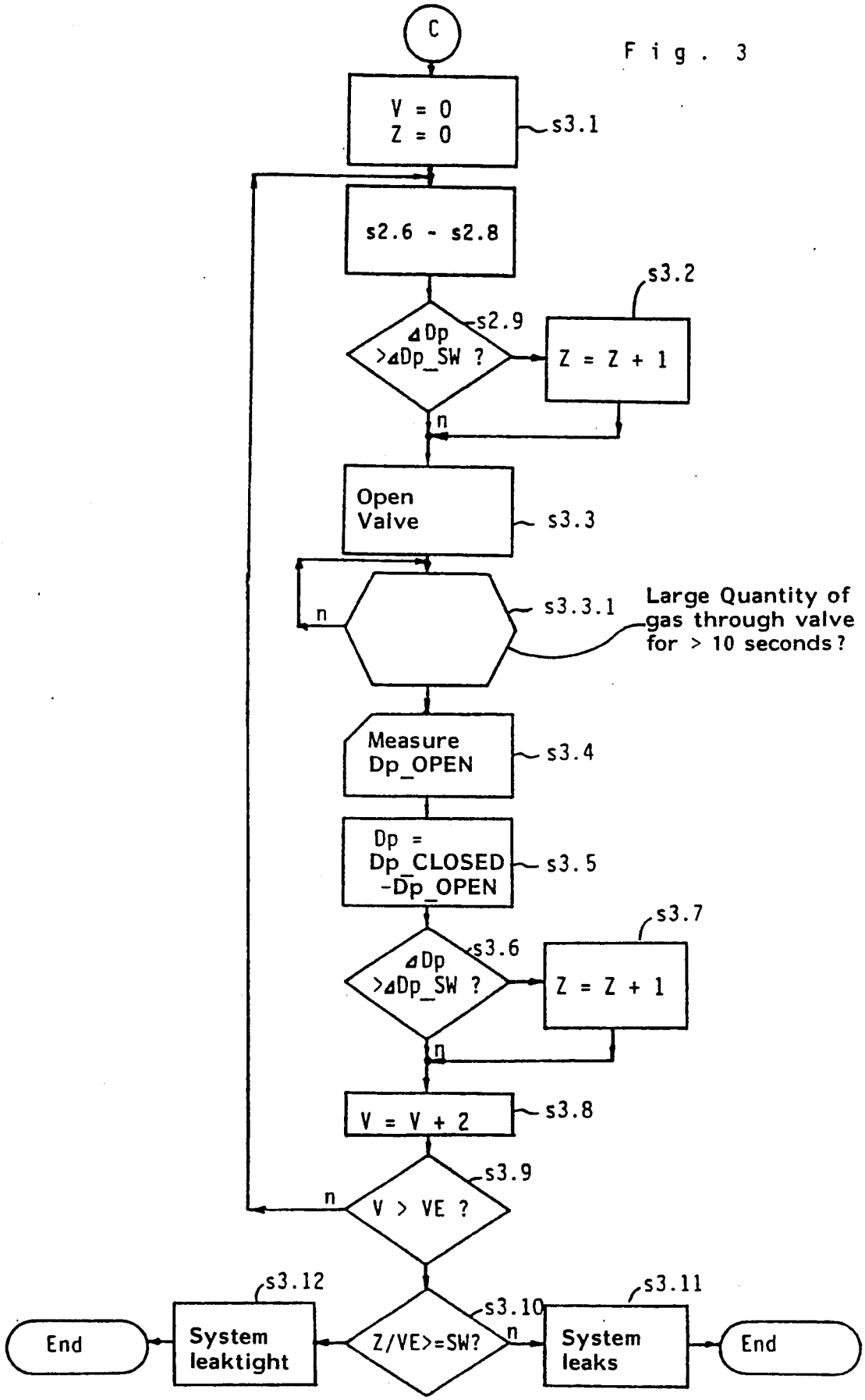
FIG. 3: flowchart relating to a change in the pressure difference check in the flowchart of FIG. 2.

The sequence according to FIG. 3 replaces the sequence of FIG. 2 from mark C onwards. In a step s3.1 following mark C, a count V for measurement operations and a count Z for successful pressure change checks are each set to zero. There then follow the already discussed steps s2.6 to s2.9. If it is ascertained in step s2.9 that the measured differential pressure change is above the predetermined threshold value, then, in a step s3.2, the count Z is incremented by one. A step s3.3 is then reached, this also being the case if the question in step s2.9 receives the answer no. In this step s3.3, the tank-venting valve is opened. As soon as there have been operating conditions with a high gas throughput through the tank-venting valve for at least a predetermined period of time, in the example 10 seconds, (step s3.3.1), the differential pressure Dp_OPEN is measured (step s3.4). There then follow steps s3.5 and s3.6, which correspond completely to steps s2.8 and s2.9, that is, the calculation of the differential pressure change and the inquiry as to whether this change exceeds the above-mentioned threshold. If it does, the count Z is once again incremented by the value one (step s3.7), whereupon (as also in the case where the question in step s3.6 receives the answer no) a step s3.8 follows, in which the count V for the measurement operations is increased by the value two. If, in the case of a subsequent inquiry (step s3.9), it results that this count V has not yet reached a final value VE, the steps from step s2.6 onwards are run again. Otherwise, a check is carried out in a step s3.10 to determine whether a minimum percentage of the total number of pressure change measurement operations has exceeded the predetermined differential pressure change threshold, that is, a check is carried out to determine whether the quotient Z/VE is larger than or equal to a threshold value SW. If this is not the case, the system is deemed to be non-operative (step s3.11); otherwise, it is deemed to be operative (step s3.12). The method then ends.

Figure 4:
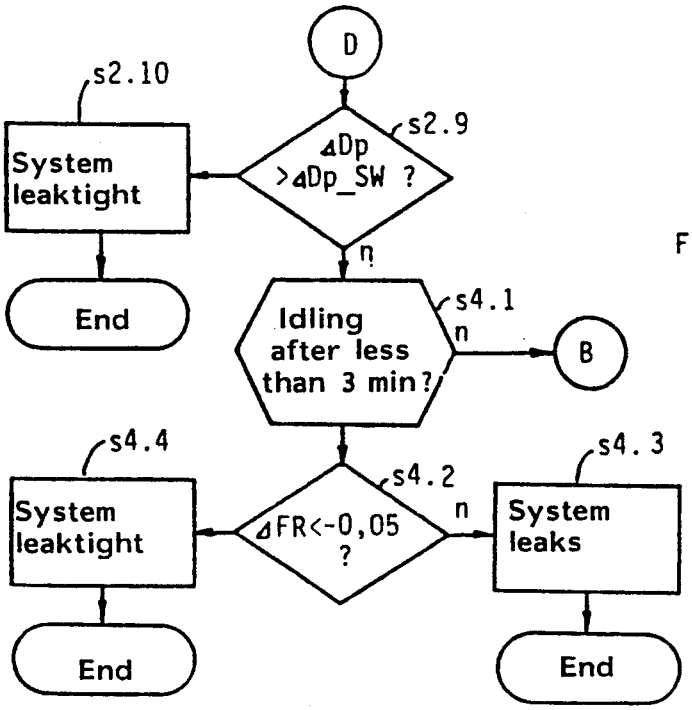
FIG. 4: flowchart for the purpose of describing method steps which can advantageously be carried out in addition to those in the flowchart of FIG. 2; and, FIG. 5: flowchart relating to a change in the effect of the lean correction check in the flowchart of FIG. 2.

Particularly reliable statements are provided by the variant of the method according to FIG. 4. It furthermore has the advantage that it manages with a less complex pressure change check. This method follows after the mark D in the sequence of FIG. 2. First there follows step s2.9 again, following which there is, likewise as before, step s2.10 if the differential pressure change ΔDp is above the predetermined threshold value. However, if this is not the case, step s2.11 is no longer reached but a new step s4.1, in which a check is made to determine whether an operating condition of the engine with a low air throughput, in the embodiment idling, is reached within a predetermined period of time, in the embodiment 3 minutes. If this is not the case, there then follows the method of FIG. 2 from mark B onwards. Otherwise, that is, if idling is present, a check is carried out (step s4.2) to determine whether a lean correction is carried out by the lambda controller, that is, in the embodiment the program inquires whether the low-pass-filtered control factor difference ΔFR is smaller than −0.05. If this is not the case, then, in a step s4.3, the system is deemed to be non-operative; otherwise it is deemed, in a step s4.4, to be operative.

This sequence is based on the consideration that, when the measured differential pressure change is smaller than the predetermined threshold value, this can in fact only be caused by the fact that, after the measurement in step s2.2, the fuel in the tank has begun to vaporize, which may be the case, for example, due to a sudden tank jarring. It must then be possible to detect the vaporized fuel with a lean correction measurement during idling since, due to the fact that the tank-venting valve is closed in step s2.6, the fuel must still be present in the adsorption filter. Since, due to the fact that the tank-venting valve is closed in the waiting time according to step s4.1, no tank venting takes place until idling is reached, mark B is reached again after the expiration of the mentioned predetermined period of time, with the subsequent step s2.4 of checking whether a high air throughput through the tank-venting valve has occurred for more that 10 seconds. This step presupposes an open tank-venting valve.

As soon as the tank-venting valve is closed, it is basically advantageous to start a basic adaptation phase immediately, deviating from the usual fixed cycle with which the tank-venting phases and basic adaptation phases otherwise alternate. This procedure is described in principle in an earlier application (DE-A-41 09 401).

Whereas the time period just mentioned is 10 seconds in the embodiment of FIG. 2 and the same value is also used for the underpressure breakdown time period Δt_CLOSED, it is advantageous to select this time period as a function of the filling level of the tank if the system has a filling level signal available. With the tank almost full, a pressure equilibrium will be established much more rapidly than with an almost empty tank. If the signal from a filling level sensor cannot be used, the time period valid for an essentially empty tank will be pregiven for the sake of safety. This is the period of 10 seconds in the embodiment.

In the procedure described above, it initially appears critical that the tank-venting process is interfered with by the closure of the tank-venting valve. It should, however, be noted that this is only the case if it has been established in step s2.2 that no lean correction is necessary. However, this shows that only a small amount of fuel was vaporizing. In this case, it is unimportant whether the tank-venting valve is arbitrarily closed for pressure measurement since it is unlikely that heavy tank venting will become necessary.

This fact also makes possible the sequence described with reference to FIG. 5, which fundamentally makes the decision on the operability of the tank-venting system with the aid of the pressure difference check. Between marks A and B, an inquiry is again made as to whether the low-pass-filtered control factor difference ΔFR is smaller than a predetermined value, here −0.15. This inquiry is repeated until the question is answered in the negative, that is, until it has been established that the amount of fuel to be recovered is so small that a pressure difference check can be carried out without noticeable consequences for the regeneration process. The steps from mark B onwards in FIG. 2 then follow, if appropriate also with the changes as explained with reference to FIGS. 3 and 4. If the difference measurement in the pressure difference check is repeated several times (FIG. 3), it may be advantageous to check at predetermined intervals, with the aid of a lean correction check, whether it is still possible to interfere with the regeneration process without noticeable consequences for the recovery of fuel.

In the above embodiments, the differential pressure Dp_OPEN was measured after the expiration of an underpressure build-up period. However, it is also possible to measure the differential pressure continuously during this period and store the respective lowest value as the decisive differential pressure.

What is claimed is:

1. A method for checking the operability of a tank-venting system for a motor vehicle having an internal combustion adsorption filter with a connecting line leading to a tank and a connecting line with an inserted tank-venting valve leading to the intake pipe of the engine, the method comprising the steps of:

making a lean correction check as soon as an operating condition is present having a low air throughput through the engine;

if a lean correction (ΔFR) of the lambda controller is detected which is less than a predetermined lean correction threshold value (ΔFR_SW), then making a pressure change check with respect to the pressure in the tank as soon as an operating condition with a high air throughput through the tank-venting valve is present; and, deeming the tank-venting system to be operative if a pressure change effect of a predetermined quality (ΔDp>ΔDp_SW) is detected.

2. The method of claim 1, wherein the tank-venting system is deemed to be operative if the lean correction by the lambda controller is greater than the lean correction threshold value (ΔFR>ΔFR_SW).

3. The method of claim 2, wherein: in the pressure change check, the tank pressure with the tank-venting valve open is only measured if a high air throughput through the tank-venting valve has been present for a predetermined underpressure build-up period (Δt_OPEN), the tank-venting valve is then closed, and the tank pressure with the tank-venting valve closed is only measured when a predetermined underpressure breakdown time period (Δt_CLOSED) has passed since the time of closing, and the difference between the two pressures is used as a pressure change.

4. The method of claim 3, wherein: the time periods are chosen as a function of the filling level of the tank in such a way that, with the tank full, they are at a minimum and, with the tank empty, they are at a maximum.

5. The method of claim 4, wherein: when no pressure change by at least the predetermined threshold value is detected, the system is deemed to the non-operative.

6. The method of claim 4, wherein: if no pressure change by at least the predetermined threshold value is detected, the tank-venting valve is closed and a check is carried out to determine whether an operating condition with a low air throughput through the engine occurs within a predetermined time period and, if this is not the case, the pressure check is repeated, whereas otherwise, a check is carried out to determine whether starting with the tank-venting valve closed to the tank-venting valve increasingly open, a lean correction is performed by the lambda controller and if this is the case, the system is deemed to be operative whereas, otherwise, it is deemed to be non-operative.

7. The method of claim 4, wherein: the pressure change check consists in that the tank-venting valve is closed at least once and a check is carried out to determine whether the tank pressure change which occurs exceeds a change threshold value (ΔDp_SW), then the tank-venting valve is opened again and a check is carried out to determine whether the tank pressure change which occurs exceeds the change threshold value and the system is deemed to be operative if a predetermined number of overshoots of the change threshold value from a predetermined number of switch-over operations of the tank-venting valve is exceeds and otherwise the system is deemed to be non-operative.

8. The method of claim 7, wherein: when a lean correction is performed by the lambda controller during the pressure change check, this check is discontinued and the system is deemed to be operative.

9. The method of claim 8, wherein the differential pressure (Dp) between the tank internal pressure and the ambient pressure is used as the tank pressure.

10. An arrangement for checking the operability of a tank-venting system for a motor vehicle having an internal combustion engine with a lambda controller, which system has an adsorption filter with a connecting line leading to a tank and a connecting line with an inserted tank-venting valve leading to the intake pipe of the engine, the arrangement comprising:

means for making a lean correction check as soon as an operating condition is present having a low air throughput through the engine;

means for making a pressure change check with respect to the pressure in the tank as soon as an operating condition with a high air throughput through the tank-venting valve is present, provided a lean correction (ΔFR) of the lambda controller is detected which is less than a predetermined lean correction threshold value (ΔFR_SW); and, means for deeming the tank-venting system to be operative if a pressure change effect of a predetermined quality (ΔDp>ΔDp_SW) is detected.

* * * * *

UNITED STATES PATENT AND TRADEMARK OFFICE

CERTIFICATE OF CORRECTION

PATENT NO. : 5,265,577

DATED : November 30, 1993

INVENTOR(S) : Helmut Denz and Andreas Blumenstock

It is certified that error appears in the above-identified patent and that said Letters Patent is hereby corrected as shown below:

In column 1, line 56: between "describes" and "tank-venting", insert -- a --.

In column 3, line 4: between "check" and "If", insert -- . --.

In column 7, line 55: between "combustion" and "adsorption", insert -- engine with a lambda controller, which system has an --.

In column 8, line 50: delete "exceed" and substitute -- exceeded -- therefor.

Signed and Sealed this

Twenty-fourth Day of May, 1994

Bruce Lehman

*Attest:*

BRUCE LEHMAN

*Attesting Officer*

*Commissioner of Patents and Trademarks*